US006806857B2

(12) United States Patent
Sempel et al.

(10) Patent No.: US 6,806,857 B2
(45) Date of Patent: Oct. 19, 2004

(54) DISPLAY DEVICE

(75) Inventors: Adrianus Sempel, Eindhoven (NL); Iain Mcintosh Hunter, Brighton (GB); Mark Thomas Johnson, Eindhoven (NL); Edward Willem Albert Young, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 236 days.

(21) Appl. No.: 09/846,420

(22) Filed: May 1, 2001

(65) Prior Publication Data

US 2001/0052606 A1 Dec. 20, 2001

(30) Foreign Application Priority Data

May 22, 2000 (EP) ..... 00201801

(51) Int. Cl.[7] ..... G09G 3/36

(52) U.S. Cl. ..... 345/92; 345/55; 345/74.1; 345/76; 315/169.1; 315/169.3

(58) Field of Search ..... 345/45, 46, 55, 345/74.1, 76, 89, 92; 315/169.1, 169.3, 169.4

(56) References Cited

U.S. PATENT DOCUMENTS

| | | | | |
|---|---|---|---|---|
| 5,973,456 A | * | 10/1999 | Osada et al. | 315/169.1 |
| 6,072,450 A | * | 6/2000 | Yamada et al. | 345/76 |
| 6,169,528 B1 | * | 1/2001 | Oguchi et al. | 345/74 |
| 6,366,026 B1 | * | 4/2002 | Saito et al. | 315/169.3 |
| 6,459,210 B1 | * | 10/2002 | Schoenbauer et al. | 315/169.3 |
| 6,528,950 B2 | * | 3/2003 | Kimura | 315/169.3 |
| 6,535,185 B2 | * | 3/2003 | Kim et al. | 345/76 |
| 6,542,138 B1 | * | 4/2003 | Shannon et al. | 345/76 |
| 6,556,176 B1 | * | 4/2003 | Okuyama et al. | 345/76 |
| 6,577,302 B2 | * | 6/2003 | Hunter et al. | 345/204 |
| 6,653,996 B2 | * | 11/2003 | Komiya | 345/76 |

FOREIGN PATENT DOCUMENTS

| | | | |
|---|---|---|---|
| WO | WO9942983 | 8/1999 | G09G/3/32 |

* cited by examiner

*Primary Examiner*—Richard Hjerpe
*Assistant Examiner*—Kimnhung Nguyen

(57) ABSTRACT

Grey scale linearity and power efficiency in active matrix (O) LEDs are enhanced by storing the grey value in a memory circuit, coupled to an adjusting circuit, preferably via a current mirror.

16 Claims, 3 Drawing Sheets

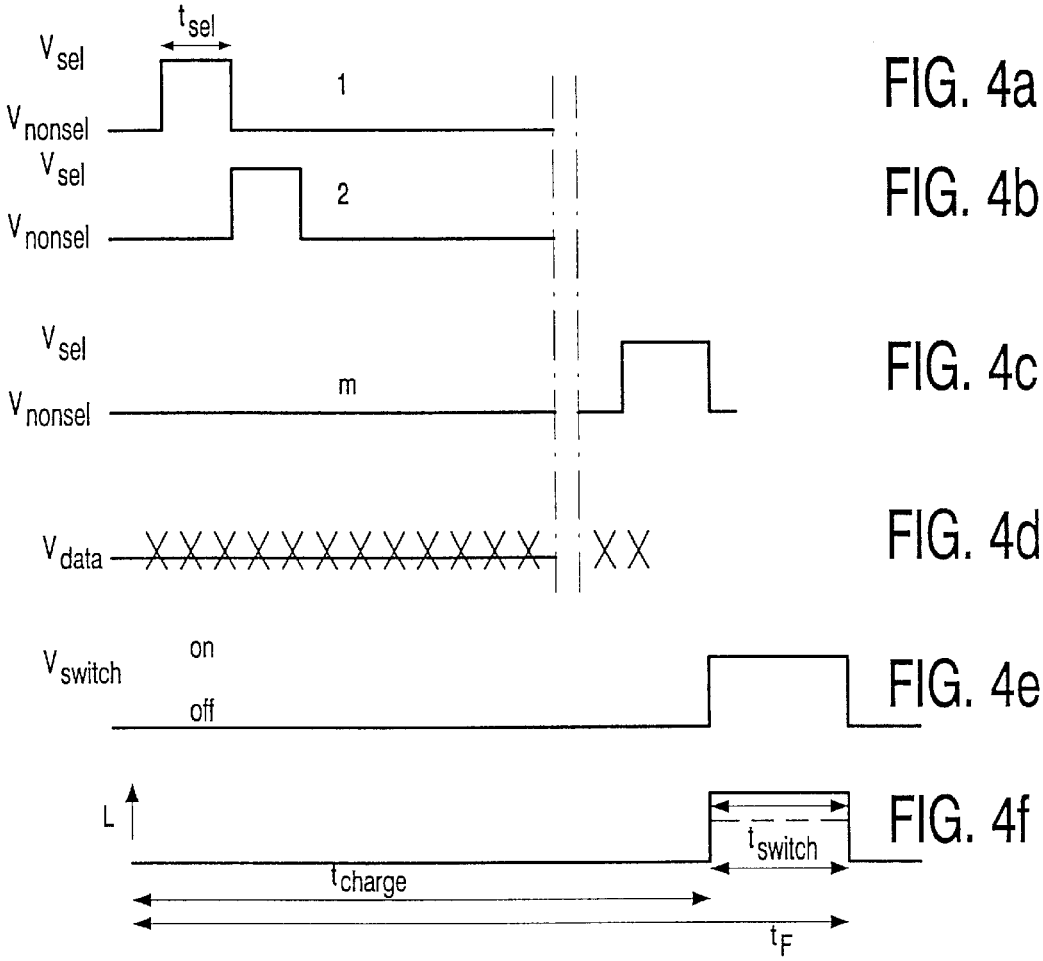
FIG. 4a
FIG. 4b
FIG. 4c
FIG. 4d
FIG. 4e
FIG. 4f
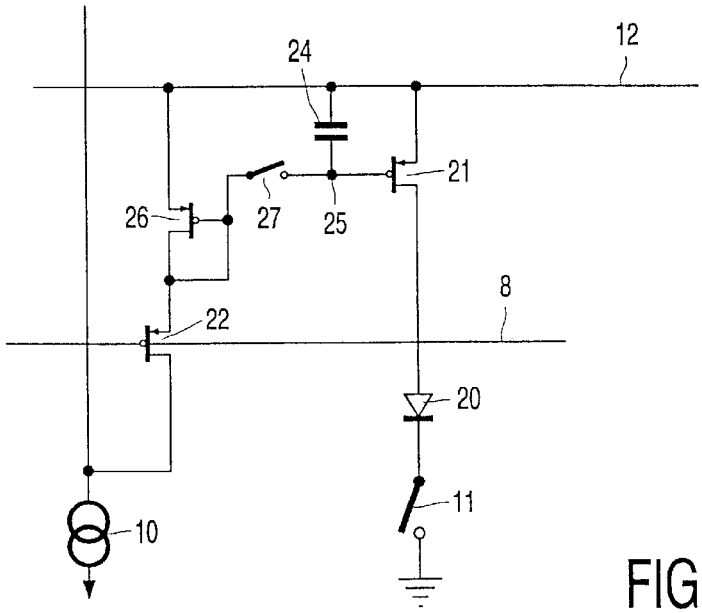
FIG. 5

DISPLAY DEVICE

CROSS-REFERENCES TO RELATED APPLICATIONS

This application claims priority benefit under 35 U.S.C. § 119 from European Patent Application 00201801.2, filed on 22 May 2000.

BACKGROUND AND SUMMARY

1. Technical Field

The invention relates to a display device comprising a matrix of pixels at the area of crossings of row and column electrodes, each pixel comprising at least a current adjusting circuit based on a memory element, in series with a luminescent element.

Such electroluminescence-based display devices are increasingly based on (polymer) semiconducting organic materials. The display devices may either luminesce via segmented pixels (or fixed patterns) but also display by means of a matrix pattern is possible. The adjustment of the pixels via the memory element determines the intensity of the light to be emitted by the pixels. Said adjustment by means of a memory element, in which extra switching elements are used (so-called active drive) finds an increasingly wider application.

Suitable fields of application of the display devices are, for example, mobile telephones, organizers, etc.

2. Description

A display device of the type described in the opening paragraph is described in PCT WO 99/42983. In said document, the current through a LED is adjusted by means of two TFT transistors per pixel in a matrix of luminescent pixels; to this end, a charge is produced across a capacitor via one of the TFT transistors. This TFT transistor and the capacitor constitute a memory element. After the first TFT transistor has been turned off, the charge of the capacitor determines the current through the second TFT transistor and hence the current through the LED. At a subsequent selection, this is repeated.

In this drive mode, the charge across the capacitor is adjusted in such a way that the LED is switched between two modi, namely the "high power mode" and the "low power mode", in which the mutual time ratio between the two modi determines the grey value. To adjust this mutual ratio accurately, many extra electronics are required, inter alia, a processor and converters. Moreover, dependent on the grey value, switching between the two modi must be effected at high frequencies. This leads to an increased power consumption and hence faster ageing. Moreover, artefacts occur in moving images.

It is, inter alia, an object of the present invention to provide a display device of the type described in the opening paragraph in which the above-mentioned problems occur to a lesser extent. To this end, such a display device is characterized in that the device comprises means at the area of a pixel for adjusting a current through the luminescent element, as well as a switch between a plurality of luminescent elements and a connection point for an operating voltage.

By means of the switch (for example, a TFT transistor or a bipolar transistor), the luminescent elements are provided with a current corresponding to the desired luminance. During adjustment of a part of the drive circuit, the switch may be closed, if desired. However, it is opened during a part of a frame period. Parts of this drive circuit (for example, the combination of a capacitor and a transistor) determine the ultimate current through the luminescent elements. Since the luminescent elements can now convey current for a much shorter time, they are preferably driven in the so-called constant efficiency range. Here, the efficiency of the LED as a function of the diode voltage is practically constant. With a shorter time of conveying current through the LED (on-time), the current at a given luminance is usually so high that the LED is driven in this constant efficiency range.

In a first embodiment, the means for adjusting a current through the luminescent element comprise at least one switching element between a column electrode and a connection point of the memory element.

A preferred embodiment of a display device according to the invention is characterized in that the column electrode can be electrically coupled to a current source, and in that such a further circuit is arranged between the column electrode and the connection point of the memory element that the current adjusting circuit substantially does not conduct during adjustment of the value of the current through the luminescent element. This limits the dissipation.

The further circuit is preferably electrically detachable from the adjusting switch, while a transistor of this further circuit, together with a transistor in the memory element in the coupled state, constitutes a current mirror. Notably when all switches are made in one process (for example, TFTs in polysilicon technology) this results in uniform properties (and thus adjustments) of the switches throughout the display surface area.

These and other aspects of the invention are apparent from and will be elucidated with reference to the embodiments described hereinafter.

BRIEF DESCRIPTION OF THE DRAWINGS

FIG. 3 shows transistor characteristics of transistors used in FIG. 1, while FIG. 4 shows an associated time diagram, and FIG. 5 diagrammatically shows a further pixel according to the invention.

The Figures are diagrammatic; corresponding components are generally denoted by the same reference numerals.

DETAILED DESCRIPTION

Figure 1:
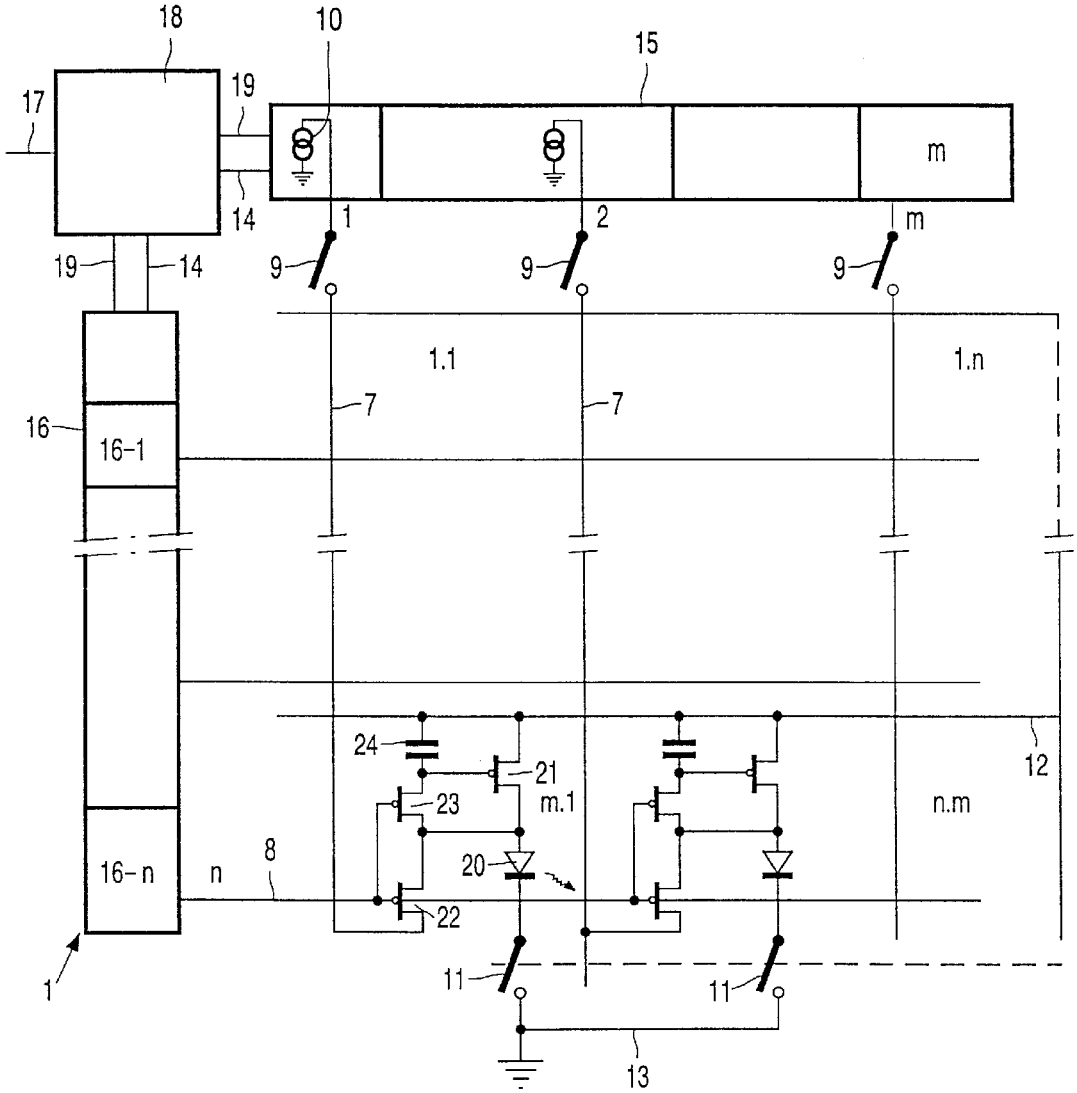
FIG. 1 shows diagrammatically a display device according to the invention.

FIG. 1 shows diagrammatically an equivalent circuit diagram of a part of a display device 1 according to the invention. This display device comprises a matrix of (P) LEDs or (O) LEDs 14 with n rows (1, 2, . . . , n) and m columns (1, 2, . . . , m). Where rows and columns are mentioned, they may be interchanged, if desired. This device further comprises a row selection circuit 16 and a data register 15. Externally presented information 17, for example, a video signal, is processed in a processing unit 18 which, dependent on the information to be displayed, charges the separate parts 15-1, . . . , 15-n of the data register 15 via supply lines 19.

The selection of a row takes place by means of the row selection circuit 16 via the lines 8, in this example, gate electrodes of TFT transistors or MOS transistors 22, by providing them with the required selection voltage.

Writing data takes place in that, during selection, the current source 10, which may be considered to be an ideal current source, is switched on by means of the data register 15, for example, via switches 9. The value of the current is determined by the contents of the data register. The current source 10 may be common for a plurality of rows. If this is not the case, the switches 9 may be dispensed with. Where this application states the phrase "can be electrically coupled to the current source", this case is also considered to be included.

During addressings, the capacitor 24 is provided with a certain charge via the transistors 21, 22 and 23. This capacitor determines the adjustment of the transistor 21 and hence the actual current through the LED 20 during the drive period, and the luminance of (in this example) the pixel (n,1), as will be described hereinafter. Mutual synchronization between the selection of the rows 8 and the presentation of voltages to the columns 7 takes place by means of the drive unit 18 via drive lines 14.

At the instant when a row, in this example row 1, is selected, the current source 10 starts to convey current. During selection, information is presented from column register 15 (in this example) via the line 7. This information determines the current through the (adjusting) transistors 21, 22 and 23 so that the capacitor 24 acquires a given charge, dependent on the conveyed current and the period of time. The other plate of the capacitor 24 is connected to the positive power supply line 12. After selection (after closure of the switch 9), this capacitor has a certain charge which determines the voltage at the gate of (control) transistor 21. The capacitor and the (control) transistor 21 jointly constitute the memory element mentioned above. The diodes (LED) 20 conduct in dependence upon the adjustment of this transistor 21. According to the invention, this conductance is regularly interrupted whereafter a new value of this conductance is adjusted or not adjusted and restored after one or more rows of pixels have been adjusted, i.e. when all transistors 21 in a number of rows have been adjusted in the manner described. At that instant (and preferably at the end of a frame time), a common switch 11 is closed for a short time so that current can flow through the transistors 21 and the LEDs 20 so that the LEDs luminesce in conformity with the adjusted value.

Figure 2:
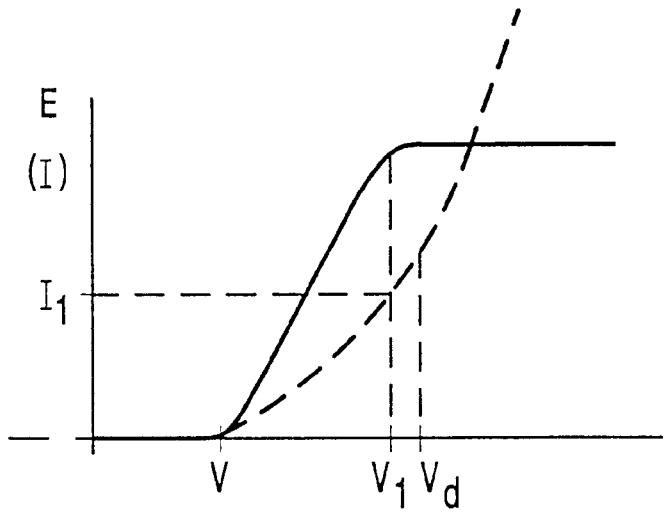
FIG. 2 shows the efficiency and the current through a LED as a function of the voltage.

The advantage thereof will be described with reference to FIG. 2. This Figure shows, as a function of the voltages across a LED, the (logarithm of the) efficiency (solid line) of the LED and the current (broken line) through the LED. The Figure shows that this efficiency reaches a given maximum from a voltage $V_1$. The current through the LEDs (and hence the luminance) increases substantially exponentially from $V_1$. Since the switches 11 between one or more LEDs 20 and, for example, ground (in this example via the line 13) are not closed during the entire frame time, the LEDs convey current for a shorter time so that the desired quantity of light can be emitted with a higher efficiency and a shorter current pulse. The switches 11 may also be closed after a part of the lines (½, ¼, . . . ) has been written (referred to as sub-frame driving).

Figure 3:
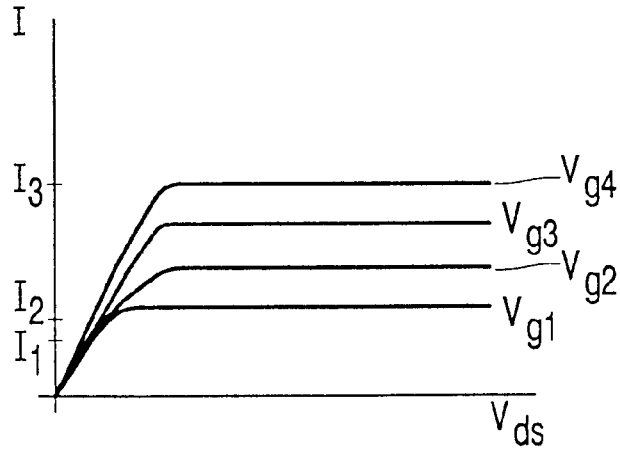

The adjustable currents preferably have such values that they are practically always larger than the current $I_1$ (FIG. 2) associated with the voltage $V_1$. To this end, the transistor 21 has a characteristic as is shown in FIG. 3. In this embodiment, transistor 21 is a TFT transistor of the p type which, dependent on the gate voltages $V_{g1}$–$V_{g4}$ supplies currents between $I_2$ and $I_3$ (FIG. 3), which currents are larger than $I_2$, while the range $I_2$–$I_3$ is sufficiently wide to adjust all grey values in the high efficiency range.

The operation of the display device is explained once more with reference to FIGS. 1 and 4. By switching on current sources 10 associated with columns 1 to m (FIG. 4(*d*)) during consecutive selection of the rows 1 to n (FIGS. 4(*a*), 4(*b*), 4(*c*)), a capacitor 24 is provided with a certain charge in each of the pixels. The information as stored in data register 15 determines, in a way similar to that described above for transistor 21, the current through transistors 22 and 23. The voltage on the supply line 12 is such that one plate of the capacitor and hence node 25 receives a voltage in the range $V_{g1}$–$V_{g4}$, which voltage is maintained after the current source 10 has been switched off.

The voltage at the node 25 and hence the voltage at the gate of transistor 21 is in the range $V_{g1}$–$V_{g4}$. However, the transistor 21 cannot conduct if the switch 11 is opened. This switch is not closed in this example until after the end of the frame period $t_F$ after the period $t_{charge}$ in which all pixels are charged. The switch 11 is closed, for example, for a short period $t_{switch}$, which period is long enough to cause the associated diodes (LED) 20 to luminesce in the correct adjustment. Since all (desired) LEDs are on for a short time with a maximal efficiency, there is less degradation in this drive mode than in the customary passive and active structures. By means of a drive circuit (not shown) the duty cycle $$\frac{t_{switch}}{t_f}$$

of the switch is adjusted, if desired, as a function of temperature or ageing, such that the efficiency remains substantially constant (optimal). It is also possible to choose the duty cycle to be different per color (in a color display device) and thus to obtain an optimal color point.

The switch 11 is preferably realized in monocrystalline silicon. In this way, a large current required for driving the total number of pixels can be supplied rapidly. This switch may be realized, for example, in a drive IC. Use may also be made of some parallel switches.

In the circuit of FIG. 1, one of the (adjusting) transistors 22, 23 may be dispensed with, if necessary. A variant is shown in FIG. 5 with an extra transistor 26 which is substantially identical to transistor 22 and has a gate which is connected via a switch 27 to the node 25 and hence to the gate of transistor 21, the gate width of which is, for example, ten times that of transistor 26. During charging of the capacitor 24, switch 27 is closed so that the voltage at node 25 acquires the desired value. At the end of the selection time, or at another suitable instant, switch 27 is opened. The voltage across the capacitor again determines the current through transistor 21 and hence the current through the LED 20 during the period when switch 11 is closed. The voltage at the memory element comprising the capacitor 24 and transistor 21 can now be adjusted by means of the "current mirror" constituted by the transistors 26, 27 with a much smaller current (a factor of 10 smaller) than that at which the LED is operated. After adjustment of a number or of all pixels, a plurality of LEDs 20 is driven simultaneously by closing one or more switches 11.

Several variations are of course possible within the scope of the invention. In given applications, not all pixels need to be adjusted in advance before the LED drive is started. A realization with bipolar transistors is also feasible.

The protective scope of the invention is not limited to the embodiments described. The invention resides in each and every novel characteristic feature and each and every combination of features. Reference numerals in the claims do not limit the protective scope of these claims. The use of the verb "to comprise" and its conjugations does not exclude the presence of elements other than those stated in the claims. The use of the article "a" or "an" preceding an element does not exclude the presence of a plurality of such elements.

We claim:

1. A display device comprising:

a matrix of pixels at the area of crossings of row and column electrodes, each pixel including a current adjusting circuit based on a memory element and a luminescent element in series with the current adjusting circuit; and a switch between a plurality of the luminescent elements and a connection point for an operating voltage, wherein the column electrode can be electrically coupled to a current source, and wherein the current adjusting circuit includes a further circuit arranged between the column electrode and a connection point of the memory element such that the current adjusting circuit substantially does not conduct during adjustment of a value of the current through the luminescent element.

2. A display device as claimed in claim 1, wherein the memory element comprises a TFT transistor and a capacitor between the gate electrode and a further connection of the TFT transistor, and wherein the further circuit comprises at least one TFT transistor with a gate electrode connected to a row electrode.

3. A display device as claimed in claim 2, wherein the further circuit comprises two series arranged TFT transistors between the column electrode and the memory element, which transistors have their gate electrodes connected a common row electrode, the common point of the two series-arranged TFT transistors being connected in an electrically conducting manner to an electrode of the luminescent element.

4. A display device as claimed in claim 1, wherein the further circuit is electrically detachable from the memory element, and wherein, in a coupled state, the further circuit constitutes a current mirror with the memory element.

5. A display device as claimed in claim 4, wherein the current mirror is asymmetrical.

6. A display device comprising:

a matrix of pixels at the area of crossings of row and column electrodes, each pixel including a current adjusting circuit based on a memory element and a luminescent element in series with the current adjusting circuit; and a switch between a plurality of the luminescent elements and a connection point for an operating voltage, wherein said display device comprises drive means for varying the time during which the switch is closed.

7. A display as claimed in claim 6, wherein the drive means for luminescent elements of a different color can close associated switches during different periods of time.

8. A display device, comprising:

a plurality of pixels arranged in a matrix of rows and columns, wherein each pixel includes:

a luminescent element; and current adjusting means for adjusting a current flowing through the luminescent element said current adjusting means including a memory element and being connected to a first terminal of the luminescent element;

a plurality of row lines each connected to one of the rows of pixels;

a plurality of column lines each connected to one of the columns of pixels;

current supply means for supplying current through the column lines to the plurality of pixels; and switching means being operatively controlled to close a circuit carrying said current flowing through at least one of the luminescent elements during a first period, and to open the circuit and prevent said current from flowing through said at least one luminescent element during a second period.

9. The display device of claim 8, wherein the switching means is operatively connected between a supply voltage terminal and a second terminal of said at least one luminescent element, to close the circuit.

10. The display device of claim 8, the current adjusting means comprises at least one switching element between a column line and the memory element.

11. The display device of claim 8, wherein the memory element comprises a transistor and a capacitor between the gate electrode and one of a source or drain electrode of the transistor, the other of the source or drain electrode being connected to the first terminal of the luminescent element.

12. The display device of claim 8, wherein the switching means comprises a plurality of switches, each switch being connected between one or more of the pixels and a supply voltage terminal, each switch being individually controllable such that a first group of pixels has the current flowing through corresponding luminescent elements during the first period, and a second group of pixels does not have the current flowing through the corresponding luminescent elements during the first period.

13. A display device, comprising:

a plurality of pixels arranged in a matrix of rows and columns, wherein each pixel includes:

a luminescent element; and current adjusting means for adjusting a current flowing through the luminescent element, said current adjusting means including a memory element and being connected to a first end of the luminescent element;

a plurality of row lines each connected to one of the rows of pixels;

a plurality of column lines each connected to one of the columns of pixels;

current supply means for supplying current through the column lines to the plurality of pixels; and switching means connected between a second end of each of the luminescent elements and a fixed voltage.

14. The display device of claim 13, wherein the current adjusting means comprises at least one switching element between a column line and the memory element.

15. The display device of claim 13, wherein the memory element comprises a transistor and a capacitor between the gate electrode and one of a source or drain electrode of the transistor, the other of the source or drain electrode being connected to the first terminal of the luminescent element.

16. The display device of claim 13, wherein the switching means comprises a plurality of switches, each switch being connected between the second terminal of one or more of the luminescent elements and the fixed voltage, each switch being individually controllable such that a first group of luminescent elements is connected to the fixed voltage during a first period, and a second group of luminescent elements is not connected to the fixed voltage during the first period.

* * * * *